US008453343B2

(12) United States Patent
Emery et al.

(10) Patent No.: US 8,453,343 B2
(45) Date of Patent: Jun. 4, 2013

(54) METHOD OF TREATMENT OF WOODEN ITEMS

(75) Inventors: Raymond R. Emery, Lincoln, ME (US); Gary D. Bies, Lincoln, ME (US); Donald Martin Perkins, Ronan, MT (US)

(73) Assignee: Hot Woods, LLC, Roman, MT (US)

( * ) Notice: Subject to any disclaimer, the term of this patent is extended or adjusted under 35 U.S.C. 154(b) by 131 days.

(21) Appl. No.: 13/248,648

(22) Filed: Sep. 29, 2011

(65) Prior Publication Data

US 2012/0018045 A1 Jan. 26, 2012

Related U.S. Application Data

(63) Continuation-in-part of application No. 12/686,124, filed on Jan. 12, 2010, now abandoned.

(51) Int. Cl.
*F26B 7/00* (2006.01)

(52) U.S. Cl.
USPC ..... 34/396; 144/364; 426/631; 42/71.01

(58) Field of Classification Search
USPC ..... 34/396, 90, 210, 218; 800/284; 435/419; 144/364, 380, 358; 428/292.1; 426/631; 42/71.01
See application file for complete search history.

(56) References Cited

U.S. PATENT DOCUMENTS

| | | | | |
|---|---|---|---|---|
| 4,597,189 | A * | 7/1986 | Cutrara | 34/518 |
| 4,890,394 | A * | 1/1990 | Troetscher | 34/256 |
| 5,992,043 | A * | 11/1999 | Guyonnet | 34/382 |
| 6,014,819 | A * | 1/2000 | Elder | 34/396 |
| 6,119,364 | A * | 9/2000 | Elder | 34/212 |
| 6,345,450 | B1 * | 2/2002 | Elder | 34/396 |
| 6,910,284 | B2 * | 6/2005 | Romeiro de Aguiar et al. | 34/476 |
| 7,748,137 | B2 * | 7/2010 | Wang | 34/396 |
| 7,866,060 | B2 * | 1/2011 | Carin et al. | 34/487 |
| 2010/0058607 | A1 * | 3/2010 | Franich et al. | 34/255 |
| 2010/0126037 | A1 * | 5/2010 | Moss et al. | 34/471 |
| 2011/0154686 | A1 * | 6/2011 | Tippmann | 34/475 |
| 2011/0308101 | A1 * | 12/2011 | Wisherd et al. | 34/255 |
| 2012/0285038 | A1 * | 11/2012 | He et al. | 34/553 |

FOREIGN PATENT DOCUMENTS

| | | | |
|---|---|---|---|
| DE | 3505429 | A1 * | 8/1986 |
| EP | 39321 | A2 * | 11/1981 |
| EP | 0922918 | A1 | 6/1999 |
| FR | 2631432 | A1 * | 11/1989 |
| GB | 2049901 | A * | 12/1980 |
| WO | WO 2009056009 | A1 * | 5/2009 |

* cited by examiner

*Primary Examiner* — Steve M Gravini
(74) *Attorney, Agent, or Firm* — Anthony D. Pellegrini

(57) ABSTRACT

An improved method for the treatment of wood in preparation for manufacture of wooden items comprising the steps of first heat treating the wood and then fashioning the wood into a finished item, whereby the resulting wooden item is darker, harder, more weather and rot resistant, and more stable than items fashioned from untreated wood.

20 Claims, 2 Drawing Sheets

METHOD OF TREATMENT OF WOODEN ITEMS

CROSS REFERENCE TO RELATED APPLICATION

This application is a continuation in part of U.S. Ser. No. 12/686,124, filed Jan. 12, 2010 now abandoned and currently pending, entitled Improved Method Of Manufacture For Wooden Gunstocks, by Emery, Raymond, et al., which is hereby incorporated by reference.

BACKGROUND OF THE INVENTION

1. Technical Field

The invention relates generally to the field of wooden items, such as musical instrument components, and is directed to an improved method of treatment of wood in preparation of manufacture of wooden items. More specifically, the invention is directed to an improved method for heat treating ipe wood and other suitable woods to achieve desirable characteristics for the wooden items made thereof while preserving the aesthetics of natural wood.

2. Description of Prior Art

Wood used in the manufacture of musical instruments and other high end items needs to be both structurally sound and aesthetically pleasing. Especially for musical instruments, wooden components must be sufficiently hard, have low moisture content and low moisture absorption properties, must be highly stable (that is, resistant to shrinkage and swelling), and be insect resistant. The shrinking and expansion of components of a musical instrument can alter the sound of the instrument and prevent it from producing a musically pleasing sound.

Ebony wood from Madagascar is a preferred wood for manufacturing certain components of musical instruments, and in particular components of stringed instruments. It also is used in the manufacture of the black keys on keyboards and the butt sections of pool cues, in chess pieces, knife handles, and other high end items.

The reason for the preference for ebony is twofold. First, ebony is very hard. For example, the fingerboards on violins and other stringed instruments take a tremendous amount of abuse from fingers pressing hard strings all along the board. Therefore, a wood that is "hard" is preferable to a softer wood that would wear quickly and have to be frequently repaired or replaced.

Wood hardness is measured by what is known as the Janka Hardness Scale. The Janka Hardness Scale measures the resistance of a type of wood to withstand denting and wear. It measures the force required to embed an 11.28 mm (0.444 in) steel ball into wood to half the ball's diameter. The measurement is expressed in pounds-force (lbf). The hardness of ebony is 3220. In contrast, the hardness of hard maple (*A. saccharum*) is only 1450. A soft wood such as eastern white pine (*Pinus strobus*) has a hardness of only 380.

A second reason for the preference for ebony is its color. The best ebony is black, blacker than any other wood. Tradition runs very strong in the luthier trade as well as other niche trades that use ebony. No other species comes close to the blackness of true ebony.

However, ebony falls under the Lacey Act of 1900, which was amended in 2008 to include provisions to curtail illegal logging. The amended Lacey Act prohibits all trade in plant and plant products (e.g., furniture, paper, or lumber) that are illegally sourced from any U.S. state or any foreign country; requires importers to declare the country of origin of harvest and species name of all plants contained in their products; and establishes penalties for violation of the Act, including forfeiture of goods and vessels, fines, and jail time. Because ebony is relatively rare, procurement of ebony often is not done consistent with the provisions of the Lacey Act. Ebony is thus difficult to obtain, and the legal supply is not sufficient to meet demand.

As a result, manufacturers have a need for a substitute wood that meets the characteristics of ebony, but which is in greater supply. One species that is an acceptable substitute is ipe (*Tabebuia Serratifolia*), a common specie of wood found abundantly in South America. Ipe has a hardness on the Janka Hardness Scale of 3684, making it sufficiently hard. However, while ipe has a naturally dark color it is nowhere near the true black of ebony. Ipe therefore must be modified to achieve proper coloration. Thermally modifying ipe brings it closer to the color of ebony than any other species of wood while retaining the hardness that is necessary. In addition, thermal modification dries the wood and reduces its susceptibility to shrinkage or swelling, as well as making it more insect resistant.

Thermal treatment is preferred over other treatment methods. For example, one method for decreasing the susceptibility of wooden items to moisture and rot is to chemically treat the wood before fashioning it into a finished item. A common method of chemically treating wood is the "pressure treatment" method, in which the wood is treated with chemicals such as arsenic and chromium (Chromate Copper Arsenate), alkaline copper quaternary (ACQ), or copper azole preservative, applied to the wood using a vacuum and pressure cycle to force the chemicals deep into the inner portions of the wood. Other chemicals may also be used. While this method tends to improve the weather resistance as well as insect and rot resistance of the wood, it does not address swelling and shrinkage issues. The toxicity of the chemicals used also renders this method less than desirable.

Another method for decreasing the susceptibility of wooden items to moisture and rot is to treat the wood in a non-pressurized manner with preservatives. These preservatives may be chemically based or derived from naturally occurring compounds, such as oils, and the preservatives are applied to the surface of the wood. While this method tends to be simpler than the pressure treatment method, and potentially uses less toxic preservatives, it fails to ensure a uniform application of the preservative into the inner portions of the wood. It also does not address swelling and shrinkage issues.

Thermal treatment, in contrast, is known to decrease the susceptibility of wooden items to moisture and rot. Wood may be heat treated prior to being fashioned into a finished product. European Patent Application EP 0 922 918 A1 (Aug. 3, 1998), to Lallukka, Tero, for "Method for heat treatment of timber", discloses such a method for treating wood.

Thermal treatment of wood is effective because of how it effects the structural composition of wood. Wood is made up, generally, of cellulose, lignin, and extractives. Cellulose (and hemicelluloses) are carbohydrates that are structural components in wood. Cellulose constitutes 40-50% and hemicelluloses 25-35% of wood. The composition and contents of hemicelluloses vary from one wood species to another. During heat treatment, both groups undergo changes, but the majority of the changes occur in hemicelluloses. After heat treatment, the wood contains a substantially lower amount of hemicelluloses. As a result of this, the amount of fungi susceptible material is significantly lower, providing one reason for heat-treated woods improved resistance to fungal decay compared with normal kiln dried wood. With the degrading of the hemicelluloses, the concentration of water-absorbing components decreases and the dimensional stability of treated wood is also improved compared to normal kiln dried wood. The decomposition temperature of the hemicelluloses is about 200-260° C., and the corresponding temperature for cellulose is about 240-350° C. Lignin holds the wood cells together. Lignin constitutes 20-30% of wood. During heat treatment, bonds between components of lignin are partially broken. Of all wood's constituents, lignin has the best ability to withstand heat. Lignin's mass starts to decrease when the temperature exceeds 200° C. Wood also contains minor amounts of small-molecule constituents known as extractives. Extractives constitute less than 5% of wood. Extractives are not structural components in wood, and most of the compounds evaporate easily during the heat treatment.

Heat treating wood changes the structure of the wood in a manner which is desirable for the manufacture of many wooden items, including components for musical instruments. During heat treatment, wood undergoes mild pyrolysis, resulting in degradation of hemicelluloses and amorphous cellulose, modification of lignin structures, and evaporation of extractives from the wood. The lignin and hemicelluloses become less hygroscopic. Surface hardness increases, moisture is 10%-50% less than in untreated wood, resins dry out or evaporate, less absorption of moisture occurs, as well as reduced molding, improved weather resistance, and moisture deformation is reduced by 30% to 90% over untreated wood.

Thermally modified wood has a lower density than untreated wood. This is mainly due to the changes of the mass during the treatment when wood loses its weight. Density decreases as higher treatment temperatures are used. This leads to overall lighter weight of the wood. However, the strength of wood has a strong correlation with density. Because thermally modified wood has slightly lower density after the treatment, it is somewhat less strong than untreated wood. However, the change in the weight-to-strength ratio is minimal, and in the case of ipe, which in its untreated state is harder than ebony, heat treating does not significantly lower its hardness. The strength of wood is also highly dependent on the moisture content and its relative level below the grain saturation point. Thermally modified wood benefits due to its lower equilibrium moisture content. Heat treated ipe is therefore sufficiently strong for use as a substitute for ebony.

Heat treatment also significantly reduces the tangential and radial swelling of wood. Heat-treated wood consequently has very low shrinkage. The water permeability of heat-treated wood is 20-30 percent lower than that of normal kiln dried wood. Thermally modified wood is resistant to insects (which are attracted to the extractives of untreated wood; such extractives are largely evaporated away during heat treatment).

Finally, heat treating ipe darkens its natural coloration, so that it takes on an appearance very close to that of ebony.

In addition to ipe, there are a few other species of wood that are sufficiently hard and sufficiently abundant that they can be acceptable substitutes for ebony when they are thermally treated. These include purpleheart (*Peltogyne paniculata*), Brazilian walnut (*Swartzia tomentosa*), and cumaru (*Dipyeryx odorata*).

In summary, heat treating wood reduces its moisture content; it reduces the ability of the wood to absorb environmental moisture; it increases the surface hardness of the wood; it increases the overall stability of the wood (that is, minimizes expansion and shrinkage); it causes the wood to become less dense, and therefore lighter; it makes the wood less susceptible to rot and insect predation; and it darkens its color. Heat treatment of wood further accomplishes these desirable characteristics without the use of toxic chemicals.

From the foregoing it is evident that there is a need for an improved method of treatment of wood for the manufacture for wooden items, particularly components for musical instruments.

It is therefore an objective of the present invention to provide an improved method of heat treatment of wood for the manufacture for wooden items.

It is a further objective of the present invention to provide an improved method of heat treatment of wood for the manufacture of components for musical instruments.

It is a further objective of the present invention to provide an improved method of heat treatment which darkens the color of wood.

It is a further objective of the present invention to provide an improved method that increases the surface hardness of the wood.

It is a further objective of the present invention to provide an improved method that reduces the moisture content of wooden items to minimize expansion and shrinkage and to increase the stability thereof.

It is a further objective of the present invention to provide an improved method that makes the wood less susceptible to environmental moisture.

It is a further objective of the present invention to provide an improved method that makes the wood less susceptible to rot and insect predation.

It is a further objective of the present invention to provide an improved method which does not use toxic chemicals to treat the wood.

It is a further objective of the present invention to provide an improved method for treating ipe (*Tabebuia Serratifolia*), purpleheart (*Peltogyne paniculata*), Brazilian walnut (*Swartzia tomentosa*), and cumaru (*Dipyeryx odorata*).

Other objectives of the present invention will be readily apparent from the description that follows.

SUMMARY

The present invention discloses an improved method of treatment of wood in preparation for the manufacture for wooden items. In one aspect, the present invention is directed to a method comprising the steps of obtaining a piece of wood of an appropriate species of tree; drying said piece of wood until said piece of wood has a moisture content of less than fifteen percent; placing said piece of wood into an oven heated to between 170° C. and 240° C.; allowing said piece of wood to be heated by the oven for between 2 and 96 hours such that said piece of wood achieves a temperature of at least 170° C.; removing said piece of wood from the oven and allow said piece of wood to cool to substantially room temperature; and cutting said piece of wood into a finished wooden item.

In an alternate aspect of the present invention, the method comprises the additional step of creating a rough wooden item after selecting a piece of wood of an appropriate species of tree, then drying the rough wooden item, heating it, allowing it to cool, and then manufacturing the rough wooden item into a finished wooden item.

In yet another alternate aspect of the present invention, the method comprises the steps of first obtaining a pre-fabricated rough wooden item, then drying the wooden item, heating it, allowing it to cool, and then and then manufacturing the rough wooden item into a finished wooden item.

Other features and advantages of the invention are described below.

DESCRIPTION OF THE INVENTION

Figure 1:
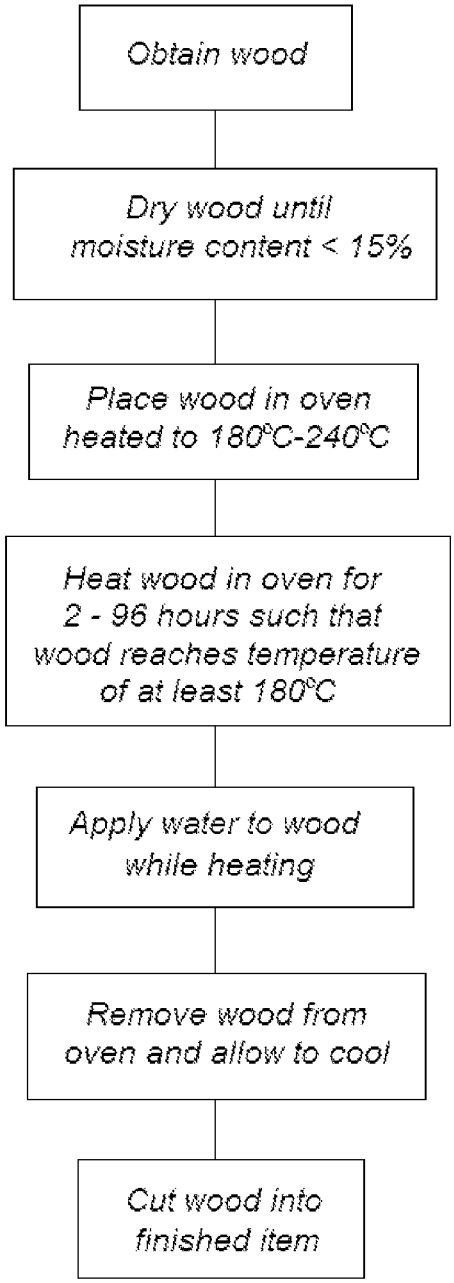
FIG. 1 is a flow chart of the steps of one embodiment of the method.
Figure 2:
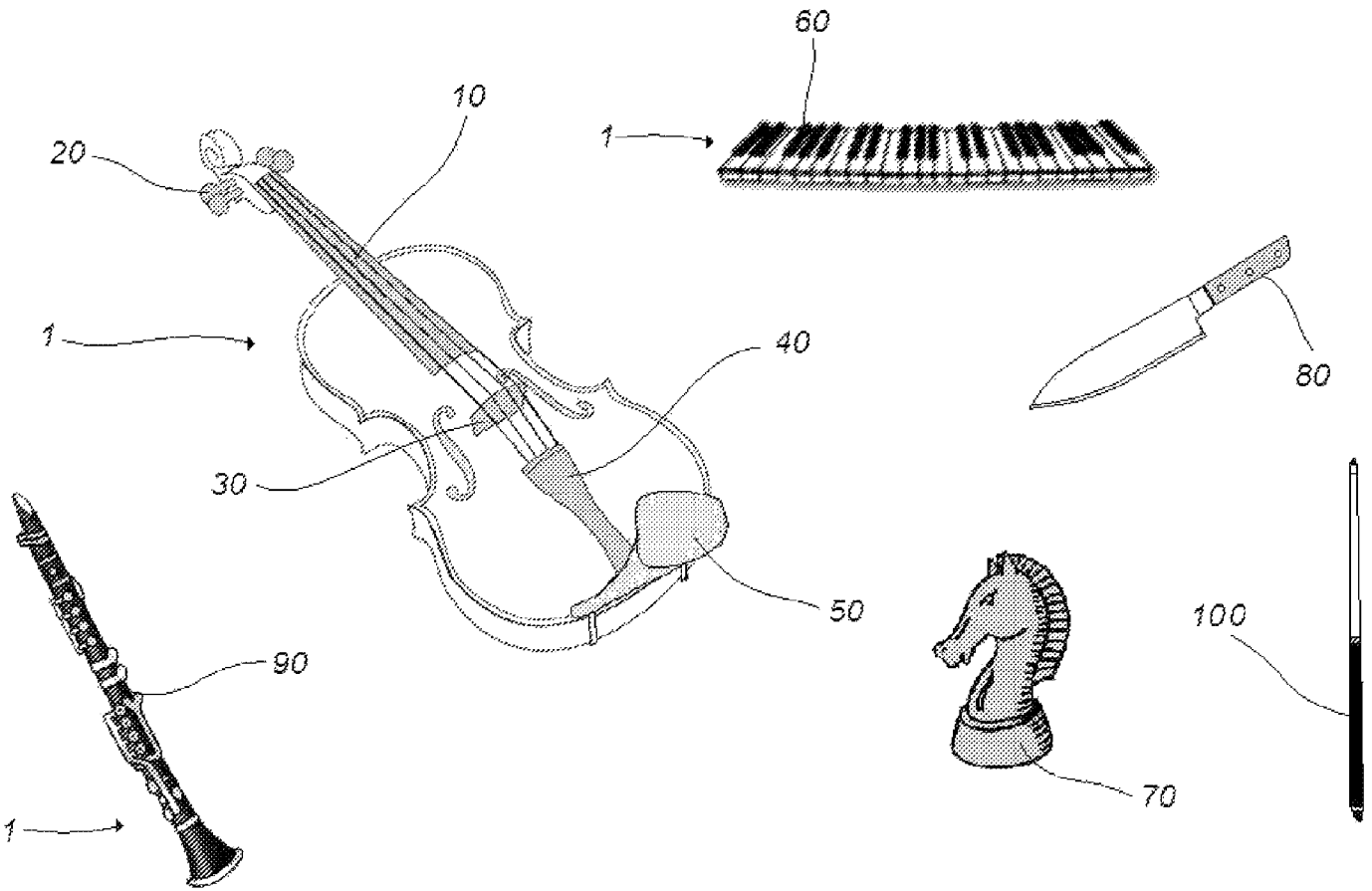
FIG. 2 depicts several exemplars of items that can be manufactured from wood treated by the method of the present invention.

The method disclosed herein is for the treatment of wood to be used in the manufacture of wooden items, for example, components of musical instruments 1. The basic method comprises the following steps:

A. obtain a piece of wood of an appropriate species of tree having certain characteristics desirable for the manufacture of wooden items, namely, hardness, strength, and stability, and the wood should be aesthetically pleasing. Suitable species of tree include ipe (*Tabebuia serratifolia*), purpleheart (*Peltogyne paniculata*), Brazilian walnut (*Swartzia tomentosa*), and cumaru (*Dipyeryx odorata*);

B. dry said piece of wood until said piece of wood has a moisture content of less than fifteen percent;

C. place said piece of wood into an oven heated to between 170° C. and 240° C.;

D. allow said piece of wood to be heated by oven for between 2 and 96 hours such that said piece of wood achieves a temperature of at least 170° C.; and E. remove said piece of wood from oven and allow said piece of wood to cool to substantially room temperature.

The foregoing Steps A through E are to be performed consecutively.

The wooden item to be manufactured from the wood treated by the method of the present invention may be one or more of the following: acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard 10, violin tuning peg 20, violin bridge 30, violin tail piece 40, violin chin rest 50, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key 60, organ key, clarinet body 90, oboe body, pool cue 100, toy game piece, chess piece 70, or knife handle 80. Other wooden items requiring hardness may also be manufactured from wood treated by the method of the present invention.

Referring to Step B, the piece of wood is dried until it has a moisture content of less than fifteen percent. The drying can be performed by any means known in the art, including air drying, kiln drying, or other means. While the moisture content can be any amount less than fifteen percent (15%), the dryer the wood the better, with a moisture content of ten percent (10%) or even five percent (5%) being desirable.

Referring to Step C, the dried piece of wood is placed into an oven heated to between 170° C. and 240° C. The oven may be any type of oven known in the art which can attain the appropriate temperatures and maintain substantially constant temperatures over time. The oven may be preheated to the desired temperature before the wood is placed therein, or it may be preheated to a preliminary, lower temperature before the wood is placed therein and thereafter heated to the desired temperature, or it may not be preheated at all, with the wood being placed in a cold oven and then the oven temperature raised to the desired temperature. In the preferred embodiment, the oven will be preheated to an intermediate temperature, preferably in excess of 100° C. The wood will be placed into the oven and then the oven temperature will be gradually raised to the desired temperature, at a substantially constant rate of increase. The preferred temperature is between 200° C. and 230° C.

Referring to Step D, the piece of wood remains in the oven to be heated at the desired temperature for between 2 and 96 hours such that the piece of wood achieves an internal temperature of at least 170° C. In the preferred embodiment the wood is heated for 36 to 72 hours, depending on the amount of wood in the oven and the species. The oven will be maintained at substantially the preferred temperature for the duration of Step D.

In one embodiment of the method, an additional Step D' is performed, concurrently with Step D. In Step D', while the piece of wood is being heated in the oven in Step D, a treatment is applied to the wood. The treatment may be any substance which enhances the structural changes occurring to the wood during heating. In the preferred embodiment the treatment is a coolant. The application of a coolant to the wood protects the surface of the wood from scorching. Because the outer surface of the wood becomes heated before the inner core of the wood, the prolonged exposure to heat necessary to heat the inner core of the wood could raise the outer surface to excessive temperatures, potentially resulting in surface damage. The coolant attenuates the surface temperature of the wood to prevent excessive heating thereof. Any form of liquid or gaseous coolant may be used. In one embodiment the preferred coolant is water. Water may be applied in liquid form to the wood during Step D. In the preferred embodiment water is applied to the wood in the form of steam. In other embodiments chemical treatments can be applied to the wood to protect the surface. The treatment may be applied continuously, or in the preferred embodiment it may be applied periodically to the wood. The timing of the application of treatment to the wood may be computer controlled to achieve the desired surface temperature of the wood for maximum protection during heating.

Referring to Step E, after the wood has been heated for the desired length of time it is removed from the oven and allowed to cool. In one embodiment the wood is simply removed from the oven without first lowering the oven temperature. In another embodiment the oven temperature is lowered prior to the removal of the wood. In this embodiment the oven temperature will be gradually lowered to an intermediate temperature, preferably in excess of 100° C., with the lowering of the oven temperature occurring at a substantially constant rate. In the most preferred embodiment the rate of decrease in temperature will be substantially the same as the rate of increase in temperature at the beginning of Step D. Once the intermediate temperature is reached the wood is removed from the oven. In all embodiments, once the wood is removed from the oven it is allowed to cool to substantially room temperature. This cooling process may be accelerated by moving cool air over the wood by the use of fans, or by placing the wood into a cooled space, such as a refrigeration unit. Alternatively, the wood may be allowed to cool simply by leaving it out in a storage area.

In preferred embodiments of the method of the present invention, an optional Step F is performed, whereby once the wood has suitably cooled it is cut into a finished wooden item. The wood may be cut in Step F by any practical means known in the art, including with hand tools, power tools, computer-controlled cutting devices, and the like. In the most preferred embodiments, finished wooden items are created by use of a computerized finishing machine.

An alternate method includes the optional step of, after selecting the appropriate piece of wood, creating a rough wooden item from the selected piece of wood before drying begins. The rough wooden item is then dried, heated, and cooled as before, and then optionally manufactured into a finished wooden item, as described above.

Yet another alternate method includes the initial step of obtaining a rough wooden item created from a piece of wood chosen from the group of the following species of tree: ipe (*Tabebuia serratifolia*), purpleheart (*Peltogyne paniculata*), Brazilian walnut (*Swartzia tomentosa*), and cumaru (*Dipyeryx odorata*). The rough wooden item is then dried, heated, and cooled as before, and then optionally manufactured into a finished wooden item, as described above.

Modifications and variations can be made to the disclosed embodiments of the method without departing from the subject or spirit of the method as defined in the following claims.

We claim:

1. An improved method of preparing a wooden item, said method comprising the following steps:

A. obtain a piece of wood from the group of the following species of tree: ipe (*Tabebuia serratifolia*), purpleheart (*Peltogyne paniculata*), Brazilian walnut (*Swartzia tomentosa*), and cumaru (*Dipyeryx odorata*);

B. dry said piece of wood until said piece of wood has a moisture content of less than fifteen percent;

C. place said piece of wood into an oven heated to between 170° C. and 240° C.;

D. allow said piece of wood to be heated by oven for between 2 and 96 hours such that said piece of wood achieves an internal temperature of at least 170° C.; and E. remove said piece of wood from oven and allow said piece of wood to cool to substantially room temperature;

whereby Steps A through E are to be performed consecutively.

2. The method of claim 1 wherein the wooden item is one or more of the group of:

acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, clarinet body, oboe body, pool cue, toy game piece, chess piece, and knife handle.

3. The method of claim 1 further comprising the following step:

F. cut said piece of wood into finished wooden item;

whereby Step F is performed after Step E.

4. The method of claim 3 wherein the piece of wood is cut into finished wooden item in Step F by use of a computerized finishing machine.

5. The method of claim 1 wherein the wood dried in Step B is dried in a kiln.

6. The method of claim 1 wherein the wood dried in Step B is air dried.

7. The method of claim 1 wherein the wood heated in Step D is heated for between 36 and 72 hours.

8. The method of claim 1 further comprising the following step:

D'. during Step D, apply a treatment to said piece of wood;

whereby Step D' is performed concurrently with Step D.

9. The method of claim 8 wherein the treatment applied in Step D' is a coolant.

10. The method of claim 9 wherein the coolant applied in Step D' is water.

11. The method of claim 10 wherein the water applied in Step D' is in the form of steam.

12. The method of claim 10 wherein the water applied in Step D' is in liquid form.

13. The method of claim 8 wherein the treatment in Step D' is applied periodically to the piece of wood.

14. The method of claim 8 wherein the treatment applied in Step D' is applied continuously to the piece of wood.

15. The method of claim 1 further comprising the following step:

A'. create rough wooden item from piece of wood;

whereby Step A' is performed after Step A and before Step B.

16. The method of claim 15 wherein the wooden item is one or more of the group of:

acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, clarinet body, oboe body, pool cue, toy game piece, chess piece, and knife handle.

17. The method of claim 15 further comprising the following step:

F. create finished wooden item from said rough wooden item by use of a computerized finishing machine;

whereby Step F is performed after Step E.

18. An improved method of preparing a wooden item, said method comprising the following steps:

A. obtain a rough wooden item created from a piece of wood chosen from the group of the following species of tree: ipe (*Tabebuia serratifolia*), purpleheart (*Peltogyne paniculata*), Brazilian walnut (*Swartzia tomentosa*), and cumaru (*Dipyeryx odorata*);

B. dry said rough wooden item until said rough wooden item has a moisture content of less than fifteen percent;

C. place said rough wooden item into an oven heated to between 170° C. and 240° C.;

D. allow said rough wooden item to be heated by oven for between 2 and 96 hours such that said rough wooden item achieves an internal temperature of at least 170° C.; and E. remove said rough wooden item from oven and allow said rough wooden item to cool to substantially room temperature;

whereby Steps A through E are to be performed consecutively.

19. The method of claim 18 wherein the wooden item is one or more of the group of:

acoustic guitar fingerboard, electric guitar fingerboard, steel guitar fingerboard, guitar tuning peg, guitar bridge, guitar tail piece, banjo fingerboard, banjo tuning peg, banjo bridge, banjo tail piece, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, toy game piece, chess piece, and knife handle.

20. The method of claim 18 further comprising the following step:

F. create finished wooden item from said rough wooden item by use of a computerized finishing machine;

whereby Step F is performed after Step E.

* * * * *